United States Patent [19]

Egli et al.

[11] 4,248,567

[45] Feb. 3, 1981

[54] ENERGY TRANSFER MACHINE

[75] Inventors: Hans Egli, Santa Monica; Joe L. Byrne; James H. Nancarrow, both of Torrance, all of Calif.

[73] Assignee: The Garrett Corporation, Los Angeles, Calif.

[21] Appl. No.: 60,100

[22] Filed: Jul. 25, 1979

Related U.S. Application Data

[62] Division of Ser. No. 892,368, Mar. 31, 1978, Pat. No. 4,197,051.

[51] Int. Cl.[3] ..... F04D 5/00

[52] U.S. Cl. ..... 415/53 T; 415/131

[58] Field of Search ..... 415/53 T, 157, 198.2, 415/213 T, 131, 132

[56] References Cited

U.S. PATENT DOCUMENTS

| | | | |
|---|---|---|---|
| 3,257,955 | 6/1966 | Worst | 415/53 T |
| 3,292,899 | 12/1966 | Egli | 415/5 |
| 3,356,034 | 12/1967 | Knowles et al. | 415/53 T |
| 3,357,635 | 12/1967 | Ullery | 415/53 T |
| 3,382,809 | 5/1968 | Brookout et al. | 415/53 T |
| 3,404,644 | 10/1968 | Skinner | 415/213 T |
| 3,476,051 | 11/1969 | Skinner | 415/213 T |
| 3,782,850 | 1/1974 | Egli et al. | 415/53 T |

*Primary Examiner*—Louis J. Casaregola

*Attorney, Agent, or Firm*—Albert J. Miller; Joel D. Talcott; Joseph A. Yanny

[57] ABSTRACT

An energy transfer machine including a stator ring carried in a casing forming a toroidal fluid path between a fluid inlet and a fluid outlet. A rotor has a blade cascade coacting with fluid in the path to transfer energy therebetween. Apparatus and methods are disclosed for controllably unloading the energy exchange between the rotor and the fluid.

6 Claims, 11 Drawing Figures

ENERGY TRANSFER MACHINE

This is a division of application Ser. No. 892,368 filed Mar. 31, 1978, U.S. Pat. No. 4,197,051.

BACKGROUND OF THE INVENTION

This invention relates to energy transfer machines. More specifically, this invention relates to energy transfer machines of the turbomachinery type wherein a working fluid and a turbomachine rotor are arranged for multiple stage energy transfer, and including apparatus and methods for controlling the level of energy exchange.

Energy transfer machines of the turbomachinery type are well known in the prior art, and typically comprise a multi-bladed rotor disposed in a fluid passage for coaction with a suitable working fluid. In one configuration, the rotor is rotatably driven to impart flow energy to the fluid. Alternately, in the case of a moving fluid, flow energy of the fluid may be used to impart rotational energy to the rotor.

In the prior art, fluid energy transfer machines have been adapted for multiple stages of energy transfer between a fluid and a single rotor in order to obtain a relatively high specific work output. More specifically, transfer machines have been developed wherein the fluid is circulated for contact and energy transfer with the blade cascade of a rotor more than one time. These machines typically involve recirculating of the fluid to the rotor via a return duct, or include stator vanes for readmission of the fluid to the rotor for second and subsequent energy transfers. However, these reentry type machines have a number of disadvantages including the presence of interstage leakage and the restriction of fluid flow to a single flow path for all conditions of machine loading.

Other prior art devices have been developed which also attempt multiple stages of energy transfer with a single rotor, but without reentry type return ducts or the like. However, these devices typically do not provide close fluid flow control, but instead allow the fluid to move in and out of rotor contact generally in a disorderly and uncontrolled fashion, primarily for lack of stator vane guidance. This disorderliness of flow results in inefficient energy transfer and undesirable machine back pressures.

U.S. Pat. No. 3,292,899, issued Dec. 20, 1966 to Hans Egli, one of the co-inventors of the present invention, discloses an energy transfer machine constituting a major improvement over the prior art in general. The energy transfer machine of this patent includes a casing with a fluid inlet and outlet, and a blade cascade on a rotor arranged for movement past the inlet and outlet. The casing is devoid of stator vanes, and is configured so that a fluid passing from the inlet to the outlet is constrained to flow in a generally spiralling path in association a number of times with the blade cascade. The geometry of the fluid path is primarily dictated by the shape of the casing, the geometry of introduction of the fluid into the housing, and the pressure gradient on the fluid which is related to the machine back pressure. For example, if the back pressure is increased for a given rotor speed, the number of passes of the fluid through the blade cascade increases, with the fluid flow pattern remaining smooth and orderly, to increase the level of energy transfer between the rotor and fluid. Importantly, for a practical level of energy exchange to occur, the fluid should pass at last twice through the blade cascade.

U.S. Pat. No. 3,782,850, issued Jan. 1, 1974 to Hans Egli, Fredrick E. Burdette, and James H. Nancarrow, two of whom are co-inventors of the present invention, discloses an energy transfer machine designed to enhance the performance and the structural simplicity of the machine disclosed in U.S. Pat. No. 3,292,899. The machine includes a casing forming a toroidal volume generally concentrically enclosing a stator ring. The ring and casing define a circumferential fluid passage of generally annular cross-section extending between a fluid inlet and a fluid outlet. A rotor has a blade cascade in close running clearance with the stator ring to coact with fluid in the passage to cause the fluid to flow in a generally spiralling path about the stator ring, and thereby make a number of passes through the blade cascade to effect multiple stages of energy transfer.

In some energy transfer machine applications, it is desirable to control or prevent the flow of fluid through the machine. For example, when the machine is used as an air pump to provide supplemental emission control air to a combustion engine, it is desirable to disconnect or stop air flow when the supplemental air is not required. In the prior art, the most common method of preventing fluid flow comprises a throttling of the flow at the machine inlet or outlet. However, with energy transfer machines of the type disclosed, a throttling of fluid flow does not unload the pump rotor, but instead increases the back pressure on the machine. Such increases in back pressure increases the number of stages of energy transfer, and thereby increases the driving load on the rotor. Accordingly, prior art throttling schemes are not satisfacory for use with such energy transfer machines.

The present invention overcomes the problems and disadvantages of the prior art by providing an energy-efficient transfer machine including apparatus and methods for unloading the machine to substantially eliminate the pressure gradient between the machine fluid inlet and fluid outlet.

SUMMARY OF THE INVENTION

In accordance with the invention, an energy transfer machine comprises a stator ring carried in a casing, and combining with the casing to form a circumferential fluid flow passage between a fluid inlet and a fluid outlet. The flow passage has a generally annular cross section, and receives the blade cascade of a rotor in close running clearance with the stator ring. In operation, the blade cascade coacts with fluid in the flow passage to effect an energy exchange therebetween, and to cause the fluid to flow from the inlet to the outlet in a generally spiralling path about the stator ring for communicating with the blade cascade two or more times.

The energy transfer machine of this invention includes apparatus and methods for controllably preventing energy exchange coaction between the blade cascade of the rotor and the circulating fluid. Specifically, in a preferred embodiment, the apparatus comprises generally cylindrical shroud means adjacent the rotor and axially movable between a first position allowing free energy exchange between the blade cascade and the fluid, and a second position concentrically about the blade cascade to prevent spiralling fluid flow in the flow passage to unload the machine. Alternate unloading apparatus includes, for example, a plurality of blocking pins rotatable with the rotor, and movable to positions between adjacent blades of the blade cascade to block spiralling fluid flow within the flow passage.

BRIEF DESCRIPTION OF THE DRAWINGS

The accompanying drawings illustrate the invention. In such drawings.

DETAILED DESCRIPTION OF THE PREFERRED EMBODIMENT

Figure 1:
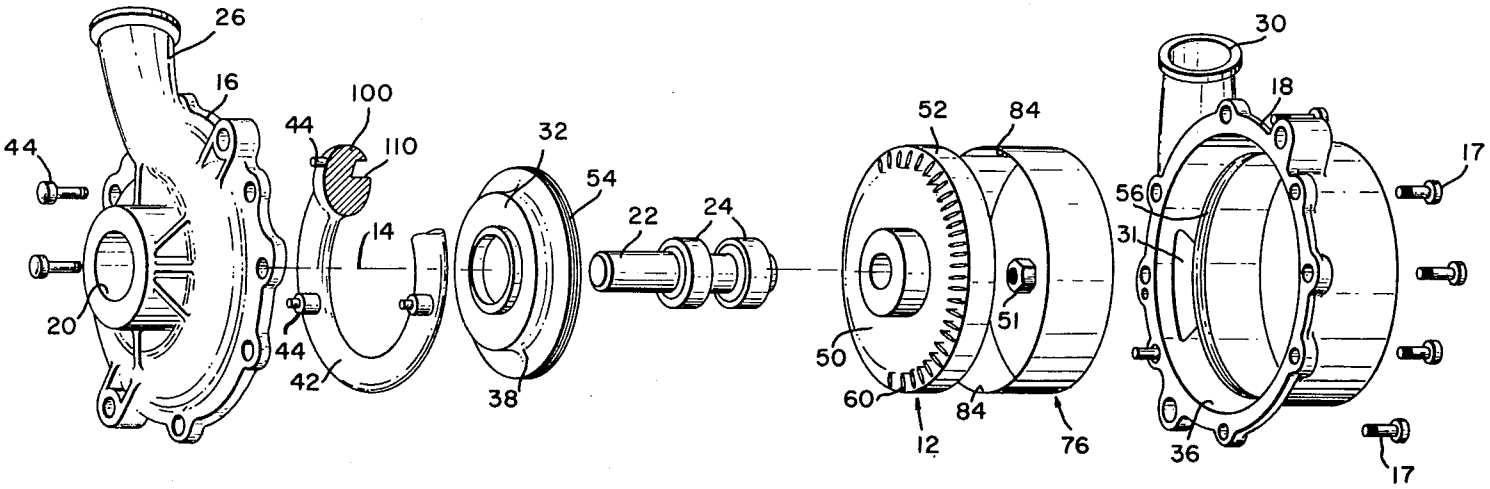
FIG. 1 is an exploded, perspective view of an energy transfer machine including unloading apparatus of this invention.
Figure 3:
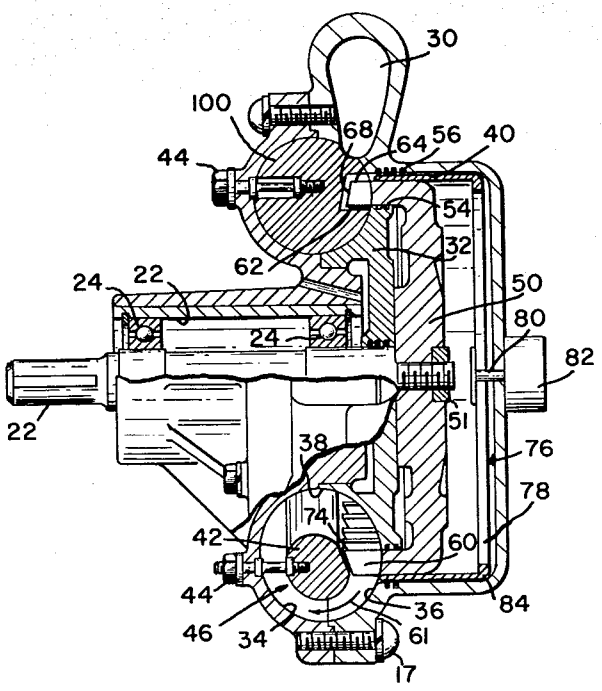
FIG. 3 is an elevation view, partially in section, of the machine of FIG. 1, and illustrating the machine generally along the line 3—3 of FIG. 2 with the unloading apparatus in an inoperative position.
Figure 2:
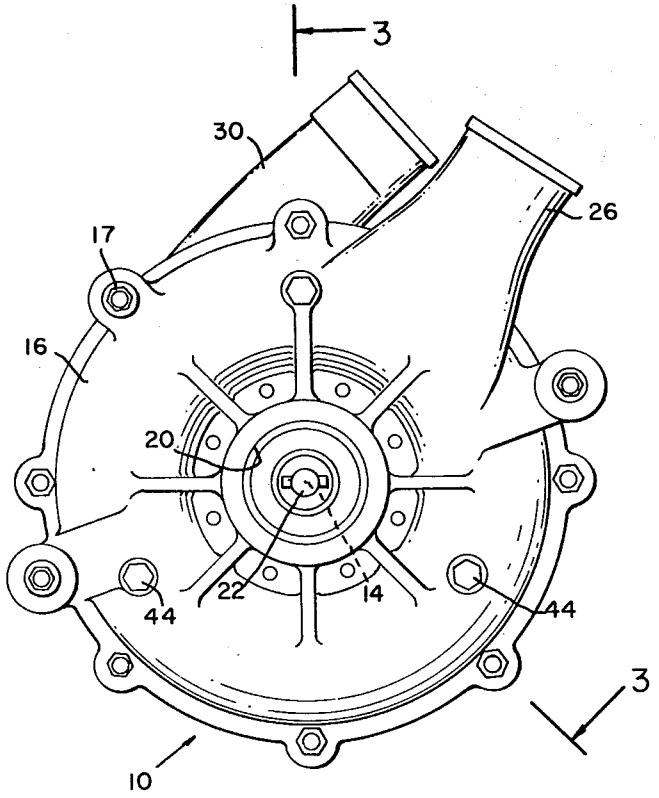
FIG. 2 is an enlarged front elevation of the machine of FIG. 1.

An energy transfer machine 10 of this invention is shown in FIGS. 1–3. The machine shown is particularly adapted for use as an air pump for providing pressurized secondary air for use in automobile emission control systems. However, if desired, the transfer machine 10 may be adapted and constructed for other uses, such as a pump, blower, compressor, turbine, or the like utilizing either gas or liquid as the working fluid medium.

As shown in the drawings, the energy transfer machine 10 comprises a split housing including a front casing 16 and a rear casing 18 coupled together by bolts 17, and including a radially oriented fluid inlet 26 and a radially oriented fluid outlet 30, respectively. A rotor 12 is positioned within the split housing between the front and rear casings 16 and 18, and is mounted on a shaft 22 for rotation therewith on a central axis 14. The shaft 22 extends through a bore 20 in the front casing 16, and is supported for rotation with respect to the casing 16 as by sets of ball bearings 24. In operation, the shaft 22 is rotatably driven as by a combustion engine (not shown) to drive the rotor 12 for purposes of imparting flow energy to fluid passing between the fluid inlet 26 and outlet 30. Alternately, in other embodiments, flowing fluid in the split housing imparts rotational movement to the rotor 12, which in turn provides a rotational mechanical power output via the shaft 22.

The front casing 16 and the rear casing 18 combine with an intermediate casing 32 to form a generally toroidal path or volume within the housing between the fluid inlet 16 and the fluid outlet 18. More specifically, the intermediate casing 32 comprises a disk-like member received over the shaft 22 between the rotor 12 and the front casing 16. The intermediate casing 32 includes an arcuate, circumferentially extending surface 38 which combines with correspondingly-formed arcuate surfaces 34 and 36 on the front and rear casings 16 and 18, respectively, to define the circumferentially extending toroidal path. As shown in cross section in FIG. 3, this toroidal path desirably has a generally circular appearance, with the exact geometry depending upon parameters such as fluid flow rate, rotor speed, pressure ratio, fluid viscosity, and the like. Accordingly, the cross sectional shape of the toroidal path may be varied as required to yield the desired fluid and energy transfer characteristics. Importantly the fluid inlet 26 opens generally tangentially into the toroidal path to admit fluid to the housing interior, and the fluid outlet includes a passage 31 for allowing fluid to flow generally in a tangential path out of the housing.

A stator ring 42 is suspended within the toroidal path in spaced relation with the path-forming arcuate surfaces 34, 36 and 38. The ring 42 extends circumferentially about the path, and is secured in position by a plurality of mounting studs or bolts 44 connected to the front casing 16. The stator ring 42 combines with the arcuate wall surfaces 34, 36 and 38 to define a fluid passage 46 of generally annular cross section within the toroidal path openly communicating with the fluid inlet 26 and the fluid outlet 30. The ring 42 includes an enlargement 100 forming a block seal in the toroidal path between the fluid outlet 30 and the inlet 26 whereby fluid is constrained to flow through the inlet 26, through the passage 46 around the substantial circumference of the housing, and exit via the outlet 30. Importantly, the annular passage 46 is generally uniformly formed about its circumference with the specific position of the ring 42 within the housing being dependent upon the desired energy transfer characteristics of the machine.

The rotor 12 comprises a disk member 50 secured on the end of the rotatable shaft 22 as by a nut 51. The disk member 50 has a forwardly projecting peripheral flange 52 which projects into the annular fluid passage 46 through an annular opening 40 formed between the intermediate casing 32 and the rear casing 18. Importantly, sets of seal rings 54 and 56 on the intermediate casing 32 and the rear casing 18, respectively, prevent fluid leakage through the annular opening 40. The flange 52 is integrally formed with a cascade of forwardly projecting rotor blades 60 which extend into the annular passage 46 of the toroidal path. As shown, each blade 60 of the cascade has a radially inner edge 62 elongated with respect to a radially outer edge 64 to form an angularly set blade tip 68. The inner and outer edges 62 and 64 are desirably formed generally in parallelism, but this parameter together with the angular orientation of the blade tip 68 may be chosen to yield the desired energy exchange characteristics.

The stator ring 42 includes an angularly set face 74 extending circumferentially about the ring and disposed for close running clearance with the angular blade tips 68 of the blades 60. That is, the face 74 is suitably formed as by machining to closely correspond to the angular plane through which the blade tips 68 rotate, and continues uninterrupted through the block seal 100 by means of a slot 110. In this manner, a close running clearance is maintained between the blades 60 and the stator ring 42 throughout the entire circumference of the ring 42 for maximum energy transfer. Alternately, the angular face 74 may be formed to have any suitable configuration conforming to a mating configuration of the blade tips 68 to maintain a close running clearance.

In operation, the blades 60 of the rotor draw fluid such as air into the housing path through the radially oriented fluid inlet 26. The rotor 12 is rotated so that the blades 60 move the fluid through the annular passage 46 from the fluid inlet 26 to the fluid outlet 30 for discharge. Importantly, the configurations of the stator ring 42, rotor blades 60, and the annular passage 46 causes the fluid to flow in a generally spiralling path about the stator ring 42, as illustrated by the arrows 61 in FIG. 3, as it moves from the fluid inlet 26 to the outlet 30. This causes the fluid to coact with the blades 60 a plurality of times before discharge to yield a multiple stage energy transfer between the fluid and the blades 60.

Figure 4:
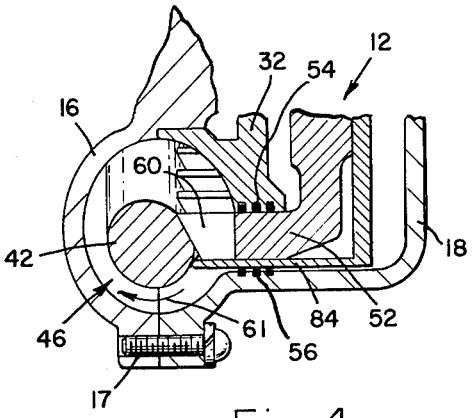
FIG. 4 is an enlarged fragmented section similar to a portion of FIG. 3 illustrating the unloading apparatus in an operating position.

A movable shroud 76 is provided for controllably unloading the energy transfer machine upon demand. As shown, the shroud 76 comprises a circular plate 78 centrally mounted on the shaft 80 of an actuator 82 such as a solenoid switch mounted on the rear casing 18. The shroud plate 78 includes a forwardly projecting peripheral flange 84 which projects into the annular passage 40 between the seal rings 56 and the rotor flange 52. The actuator 82 is responsive to a suitable command signal to move the flange 84 of the shroud between an inoperative position allowing free energy exchange between the fluid and the rotor blades 60, and an operating position blocking such energy exchange. That is, as shown in FIG. 3, the shroud 76 is positioned in an inoperative position with the plate 78 adjacent the rear casing 18 and the actuator shaft 80 unextended. This positions the shroud flange 84 in a position projecting into, but not beyond, the annular passage 40 so as not to interfere with the spiralling flow of the fluid. However, as shown in FIG. 4, the shroud plate 78 may be translated away from the rear casing 18 by the actuator 82 to move the shroud flange 84 to a position concentrically surrounding the blades 60. This blocks the fluid from a spiralling flow path to prevent multiple stages of fluid-rotor energy transfer, and thereby effectively unloads the machine. Of course, when it is desired to resume multiple stage energy transfer operation, the shroud is moved back to the position shown in FIG. 3.

Figure 5:
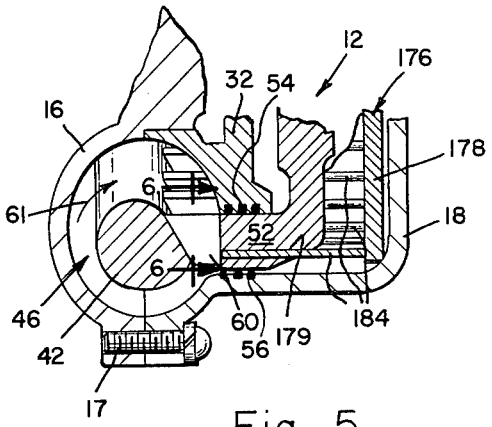
FIG. 5 is a fragmented section similar to FIG. 4 illustrating a modified embodiment of the invention with the unloading apparatus in an inoperative position.
Figure 7:
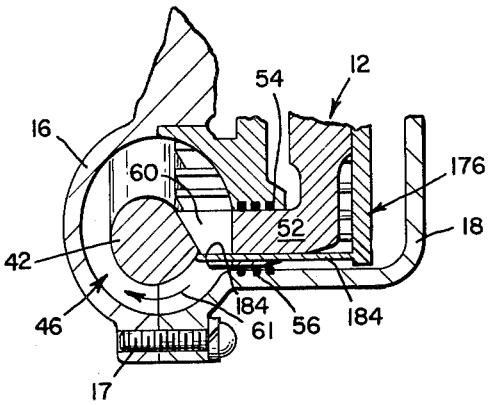
FIG. 7 is a fragmented section similar to the embodiment of FIG. 5 illustrating the unloading apparatus in an operating position.
Figure 6:
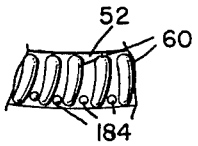
FIG. 6 is an enlarged fragmented vertical section taken on the line 6—6 of FIG. 5.

A modified embodiment of the invention is shown in FIGS. 5 through 7 including front, rear, and intermediate casings 16, 18 and 32 forming an annular fluid flow passage 46 about a stator ring 42. A rotor 12 includes a cascade of blades 60 in close running clearance with the stator ring 42 to provide multiple stages of fluid-rotor energy transfer in the same manner as the embodiment described above. However, in this embodiment, a modified shroud 176 includes a plate 178 movable as by an actuator (not shown) in the same manner as above, but including a plurality of forwardly extending peripheral pins 184. These pins 184 are received through a corresponding number of holes 179 formed in the flange 52 of the blade rotor 12, with each hole 179 being positioned between a pair of the blades 60. In operation, during free energy exchange between the blades 60 and the fluid, the pins 184 are received in the holes 179 so as to cause the shroud 176 to rotate with the shaft. However, the pins do not extend substantially beyond the holes 179 into the annular fluid flow passage 46, and thereby do not interfere with energy exchange operation. When it is desired to unload the machine the actuator moves the shroud plate 178 away from the rear casing 18 to move the pins 184 into the spaces between the rotor blades 60 to prevent spiralling fluid flow within the machine, as shown in FIG. 7.

Figure 8:
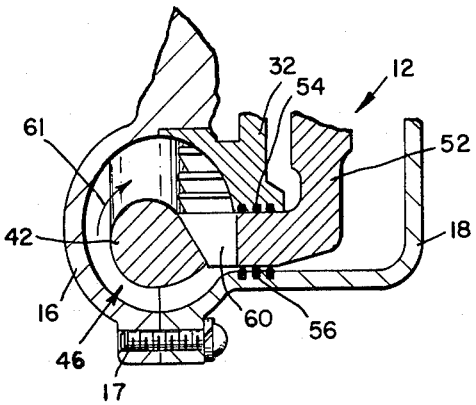
FIG. 8 is a fragmented section similar to FIG. 4 illustrating another modification of the invention.
Figure 9:
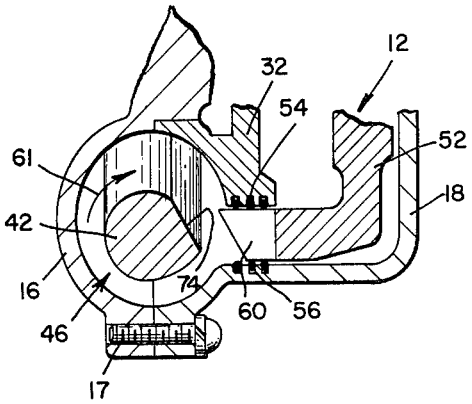
FIG. 9 is a fragmented section similar to the embodiment of FIG. 8 showing the machine in an inoperative position.

Another modification of the invention is shown in FIGS. 8 and 9. In this embodiment, the rotor 12 is mounted on the shaft 22 for rotation therewith, and for axial translation with respect thereto. The rotor is axially movable on the shaft 22 by means of an actuator of the type described above to move the rotor blades between a loaded position and an unloaded position. Specifically, as shown in FIG. 8, the rotor blades 60 are in close running relation with the stator ring 42 to cause the fluid to flow through the annular passage in a spiralling fashion. However, the rotor is movable to the unloaded position shown in FIG. 9 with the rotor blades 60 withdrawn from the stator ring 42 to unload the machine.

Figure 10:
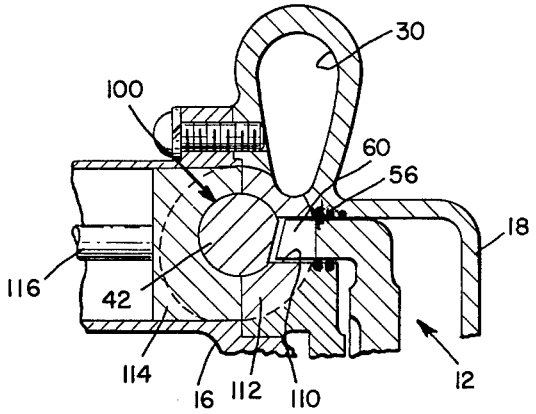
FIG. 10 is a fragmented section of a portion of an energy transfer machine illustrating still another modified embodiment of the invention, with the unloading apparatus in an inoperative position.
Figure 11:
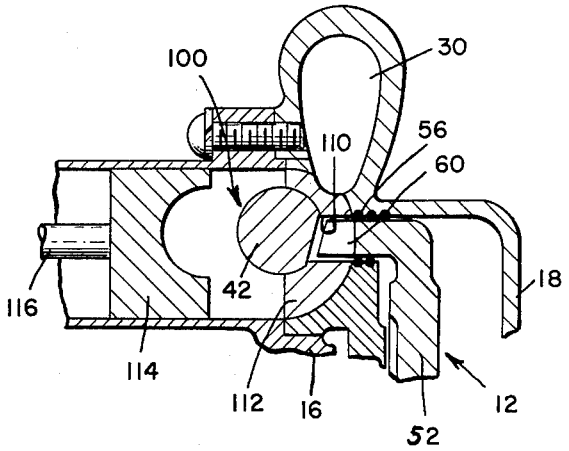
FIG. 11 is a fragmented section similar to the embodiment of FIG. 10 showing the unloading apparatus in an operating position.

Still another modification of the invention is shown in FIGS. 10 and 11. In this embodiment, the block seal 100 is divided into separate meridional sections 112 and 114. The section 112 adjacent the rotor blades 60 is formed integrally with the stator ring 42 as described with respect to the previous embodiments. However, the section 114 is separately formed from the stator ring 42, and is carried on an actuator rod 116 for movement toward and away from the remaining section 112. That is, as shown in FIG. 10, the movable section 114 may be retained adjacent the other section 112 to form a complete block seal whereby a substantial circumferential pressure gradient is formed along the flow passage 46 between the fluid inlet 26 and the outlet 30 for normal energy transfer machine operation. As shown in FIG. 11, when the movable section 114 is moved away from the section 112, fluid is allowed to flow through the machine past the now open block seal to remove and destroy the circumferential pressure gradient, and thereby unload the machine.

A variety of further modifications and improvements of the energy transfer machine of this invention are believed to be possible without varying from the scope of this invention. For example, it is contemplated that means may be provided for adjusting the machine from a free energy exchange condition to a fully unloaded condition, or any operating condition therebetween. Accordingly, it is intended that the modifications and arrangements described herein are not patentably limiting except by way of the appended claims.

What is claimed is:

1. An energy transfer machine comprising a housing having a fluid inlet and a fluid outlet generally adjacent to each other, and forming a generally toroidal volume between said inlet and outlet; a stator ring suspended within the toroidal volume and combining with said housing to define a generally circumferential passage having an annular cross section, said stator ring including an enlarged block seal interposed between said fluid inlet and outlet to cause fluid flowing through said housing to flow through said flow passage; a rotatable rotor including a cascade of blades operably disposed for energy transfer coaction with fluid in the flow passage and configured to cause the fluid to flow upon rotor rotation in a generally spiralling path about said stator ring, said rotor being mounted with respect to said housing for axial translation with respect to said stator ring; and means for axially translating said rotor between a loaded position with the blades in close running clearance with said stator ring to cause fluid to flow in a spiralling path about said stator ring, and an unloaded position with the blades axially withdrawn from said stator ring for controllably preventing the fluid from flowing in a generally spiralling path about said stator ring for controllably unloading the machine.

2. An energy transfer machine as set forth in claim 1 wherein the radially inner edges of the blades of said cascade are elongated with respect to the radially outer edges to define angularly set blade tips on said blades, and said stator ring is formed to have an angularly set face matingly corresponding with said blade tips.

3. In an energy transfer machine having a housing with a fluid inlet and a fluid outlet generally adjacent to each other and communicating with a generally toroidal volume, a stator ring suspended within the toroidal volume and combining with the housing to define a generally circumferential flow passage of annular cross section, said stator ring including an enlarged block seal interposed between said fluid inlet and outlet to cause fluid flowing through the housing to flow through said flow passage, and a rotor mounted for rotation about an axis common to the stator ring and including a cascade of blades operably disposed for energy transfer coaction with fluid in the flow passage and configured to cause the fluid to flow in a generally spiralling path about the stator ring, apparatus for unloading the machine comprising means disposed adjacent the rotor for controllably and selectively preventing fluid flow between each adjacent pair of blades of said cascade, and thereby preventing spiralling fluid flow about said stator ring to unload the machine, said means comprising actuator means coupled between said housing and said rotor for axially translating said rotor with respect to said stator ring between a loaded position with the blades in close running clearance with said stator ring to cause fluid to flow in a spiralling path about said stator ring and an unloaded position with the blades axially withdrawn from said stator ring so that fluid is preventing from flowing between the blades of said cascade to prevent the rotor from imparting spiralling motion to the fluid.

4. An energy transfer machine comprising a housing having a fluid inlet and a fluid outlet generally adjacent to each other, and forming a generally toroidal volume between said inlet and outlet; a stator ring suspended within the toroidal volume and combining with said housing to define a generally circumferential flow passage having an annular cross section, said stator ring including an enlarged block seal interposed between said fluid inlet and outlet to cause fluid flowing through said housing to flow through said flow passage; a rotatable rotor including a cascade of blades operably disposed for energy transfer coaction with fluid in the flow passage and configured to cause the fluid to flow upon rotor rotation in a generally spiralling path about said stator ring; and actuator means coupled between said housing and said rotor for axially translating said rotor with respect to said stator housing ring between a loaded position with the blades in close running clearance with said stator ring to cause fluid to flow in a spiralling path about said ring and an unloaded position with the blades axially withdrawn from said stator ring so that fluid is prevented from flowing between the blades of said cascade to prevent the rotor from imparting spiralling motion to the fluid.

5. In an energy transfer machine having a housing with a fluid inlet and a fluid outlet generally adjacent to each other and communicating with a generally toroidal volume, a stator ring suspended within the toroidal volume and combining with the housing to define a generally circumferential flow passage of annular cross section, said stator ring including an enlarged block seal interposed between said fluid inlet and outlet to cause fluid flowing through the housing to flow through said flow passage, and a rotor mounted for rotation about an axis common to the stator ring and including a cascade of blades operably disposed for energy transfer coaction with fluid in the flow passage and configured to cause the fluid to flow in a generally spiralling path about the stator ring, a method of unloading the machine comprising the steps of mounting an actuator on said housing; coupling an actuator shaft between said rotor and said housing; and controllably and selectively operating said actuator and actuator shaft for axially translating said rotor between a first position with the blades in close running clearance with the stator ring for allowing spiralling fluid flow about the stator ring, and a second position with the blades axially withdrawn from the stator ring for preventing fluid flow between adjacent blades to prevent spiralling fluid flow to unload the machine.

6. In an energy transfer machine having a housing with a fluid inlet and a fluid outlet communicating with a generally toroidal volume, a stator ring suspended within the toroidal volume and combining with the housing to define a generally circumferential flow passage of annular cross section and a rotor mounted for rotation about an axis common to the stator ring and including a cascade of blades operably disposed for energy transfer coaction with fluid in the flow passage and configured to cause the fluid to flow in a generally spiralling path about the stator ring, a method of unloading the machine comprising the steps of mounting an actuator on said housing, coupling an actuator shaft between said rotor and said housing, and selectively operating said actuator shaft for axially translating said rotor with respect to said stator ring whereby said rotor is movable between a loaded position with the blades in close running clearance with the stator ring, and an unloaded position with the blades withdrawn from the stator ring so that the rotor is prevented from imparting spiralling motion to the fluid.

* * * * *